US005765500A

United States Patent [19]

Nordbø

[11] Patent Number: 5,765,500

[45] Date of Patent: Jun. 16, 1998

[54] LIFE RAFTS ON SHIPS

[75] Inventor: Kåre Nordbø, Selje, Norway

[73] Assignee: Selantic Industrier A/S, Agotnes, Norway

[21] Appl. No.: 356,407

[22] PCT Filed: Jul. 9, 1993

[86] PCT No.: PCT/NO93/00113

§ 371 Date: Apr. 24, 1995

§ 102(e) Date: Apr. 24, 1995

[87] PCT Pub. No.: WO94/01324

PCT Pub. Date: Jan. 20, 1994

[30] Foreign Application Priority Data

Jul. 10, 1992 [NO] Norway ..... 922750

[51] Int. Cl.[6] ..... B63C 9/22

[52] U.S. Cl. ..... 114/366; 114/365

[58] Field of Search ..... 114/365, 366, 114/375, 259, 258, 376, 377, 362, 368, 369

[56] References Cited

U.S. PATENT DOCUMENTS

| | | | |
|---|---|---|---|
| 2,103,708 | 12/1937 | Campbell | 114/365 |
| 5,331,913 | 7/1994 | Tanaka et al. | 114/366 |

FOREIGN PATENT DOCUMENTS

| | | | |
|---|---|---|---|
| 30 00 728 | 6/1990 | Germany . | |
| 5131977 | 5/1993 | Japan | 114/375 |
| 7509084 | 2/1977 | Netherlands | 114/365 |
| 154720 | 3/1990 | Norway . | |
| 37081 | 1/1878 | United Kingdom | 114/365 |
| 1 465 062 | 2/1977 | United Kingdom . | |
| 2 040 844 | 9/1980 | United Kingdom . | |
| 2 131 369 | 6/1984 | United Kingdom . | |
| 2150903 | 7/1985 | United Kingdom | 114/365 |
| WO 84/02658 | 7/1984 | WIPO . | |
| WO 90/11799 | 10/1990 | WIPO . | |

*Primary Examiner*—Edwin L. Swinehart
*Attorney, Agent, or Firm*—Bell, Seltzer, Park & Gibson, P.A.

[57] ABSTRACT

A system for deploying life rafts from ships, wherein the life rafts are of the inflatable type and where there are stocking-like bodies for transfer of personnel from the ship to at least one of the life rafts. The life rafts are arranged in groups which are loosely connected with a common bottom frame, and where each group includes a reception raft and several evacuation rafts detachably connected with the reception raft. The bottom frame is suspended from at least one winch wire arranged from a support frame which can be moved from a parked position inside the ship's side to an operative position outside the ship's side. When the support frame is in an operative position, the bottom frame can be lowered into the water by means of the winch. The winch wires pass through sliding guides in the bottom of the reception raft and sliding guides in a known per se rescue stocking which is stretched between the support frame and the reception raft. The reception raft is automatically inflated when the bottom frame is lowered below the surface of the water, while at the same time the evacuation rafts remain afloat uninflated beside the reception raft and detachably connected with it. The evacuation rafts' inflation mechanism can be actuated manually from the reception raft as required, thus maintaining a continuous, safe escape route from the ship's deck to the evacuation rafts.

10 Claims, 5 Drawing Sheets

LIFE RAFTS ON SHIPS

BACKGROUND OF THE INVENTION

1. Field of the Invention

The invention concerns a system for deploying life rafts from ships, wherein the life rafts are of the inflatable type and wherein there are stocking-like bodies for transferring personnel from the ship to at least one of the life rafts. The life rafts are arranged in groups which are loosely connected with a common bottom frame 1, and wherein each raft group comprises a reception raft 2 and several evacuation rafts 3 detachably connected with the reception raft.

The above-mentioned bottom frame 1 is suspended from at least one winch wire 4 arranged from a support frame 5 which can be moved from a parked position inside the ship's side to an operative position outside the ship's side. The winch wire(s) pass through sliding guides *6a* in the bottom of the reception raft and in sliding guides *6b* in a known per se escape stocking 7 which is packed between the support frame and the reception raft. When the support frame 5 is in an operative position the bottom frame 1 can be lowered into the water by means of the winch 8 while the escape stocking is simultaneously unfolded. The reception raft is automatically inflated when the support frame sinks below the waterline, while at the same time the evacuation rafts remain floating uninflated beside the reception raft and detachably connected with it. The evacuation rafts' inflating mechanism can be actuated manually from the reception raft when required, thus maintaining a continuous, safe escape route from the ship's deck to the evacuation rafts.

2. Description of the Prior Art

Evacuation from ships in distress has traditionally been performed by the deployment of davit launched lifeboats, where all the evacuees board the lifeboat before it is lowered into the water. In fair weather and calm waters this is a relatively safe operation, which can also be used in situations other than emergencies, such as when disembarking passengers from tourist ships in areas where the ship cannot go alongside the quay.

However, in rough seas, which is probably the case when a ship is in distress, the deployment of davit launched lifeboats is an extremely risky operation. There are several reasons for this: The lifeboats can easily be smashed to pieces against the ship's side when they hit the waves. If the davit wires are not released synchronously and at the right moment the lifeboats can overturn or fall into the water from too great a height. Stress or panic on the part of the crew or passengers can lead to critical misjudgements. When the boat is afloat in the water and is detached from the davit wires it is facing alongside and not away from the ship's side, thus making it difficult to manoeuvre the boat to a safe distance in time. In the panic, the boats can also be put into the water too soon, thus leaving many passengers on board or they have to spend precious time in finding another "vacant" lifeboat station. Or the passengers may be unevenly distributed with the result that some lifeboats become overcrowded and not very seaworthy. Finally it should be mentioned that all the passengers are on board the lifeboat during the actual lowering, so that even a minor technical mishap with only one of several lifeboats can have fatal consequences despite ample surplus capacity in the lifeboat fleet.

Many proposals have been presented for solving these problems. For example so-called free fall lifeboats have been introduced, which are covered lifeboats with an extra strong construction and special design, which fall or slide in free fall out into the water and at the moment of impact receive a hydrodynamic force pushing them clear of the ship independent of the lifeboat's motor power. These lifeboats have a reduced risk of colliding with the ship's side, but otherwise still retain many of the same disadvantages as davit launched lifeboats, particularly disadvantages associated with the batch-type operational method and vulnerability to wrong handling. In addition some new hazards are introduced: It is extremely important that all the passengers should be securely strapped in before the lifeboat is dropped into the water. It can also be fatal if the lifeboat in free fall hits other lifeboats, people, rafts or objects in the water. Moreover, free fall lifeboats are heavy, expensive and space-consuming installations.

In addition to lifeboats, rafts are often used. There are small rafts made of rigid plastic with a coil of rope round them, which are principally intended as buoyancy means for people who have fallen or jumped into the water to hold on to. There are also inflatable rubber rafts with room for several tens of people. These rafts can withstand the strain of almost unlimited impacts and will therefore not be smashed against the ship's side. They do not normally have any means of propulsion apart from perhaps some paddles with which to manoeuvre if necessary, e.g. in order to pick up a person in the vicinity from the water. Nevertheless rubber rafts are considered by very many people to-day to be a safer evacuation means than lifeboats. The rafts have relatively little freeboard with the risk of falling overboard, but they can also be supplied with tent-shaped canopies.

The problem is primarily to transfer passengers and rafts safely into the water. There are davit launched rafts where the rafts with the evacuees are suspended by means of various straps on a crane wire. This can be a rather hazardous operation, due amongst other things to the severe effects of the wind on the relatively light raft during lowering, and due to the risk of mechanical failure in the davit crane which is constantly exposed to the harsh effects of the weather and the sea and which is seldom used.

Rafts can also be thrown or dropped overboard in a packed condition and inflated when they hit the water. These rafts can be entered by persons who have arrived in the water with life jackets by some other means. For boats up to a certain freeboard height there have been developed inflatable chutes or chutes suspended in a rigid metal construction with flexible connection to a mustering point on the vessel's deck. The chutes preferably end in a reception raft in the water. There is very little documentation on the usefulness of such chutes in rough seas. The chutes place a limit on freeboard height from the point of evacuation. Furthermore, chutes which comprise a rigid metal construction are space-consuming. For the rafts which are thrown into the water in a packed condition, usually in rigid plastic boxes (GRP), there is also a risk of the GRP's hitting one another and being destroyed, or hitting people in the water with even more fatal consequences.

From amongst others Norwegian patent 134291 there is known an elastic, spiral-shaped chute inside a closed elastic tube or "stocking", which is deployed from a ship's deck to a reception raft. This chute can be stowed together with the reception raft folded up in a protected room when it is not in use, and can be used from a relatively great height. One problem, however, is that both the raft and the sock are very vulnerable to the effects of wind. Another problem is how to pull evacuation rafts over to the reception raft and constantly hold new evacuation rafts in readiness.

From Norwegian patent no. 149760 there is known a reticulate escape stocking which can be raised and lowered from a house or a container where it can be stored in a folded condition. An advantage with the reticulate escape stocking is that it is little affected by wind, and it protects the evacuees without preventing them from seeing out of the stocking in order to survey the situation. This reduces the risk of panic or refusal.

SUMMARY OF THE INVENTION

The object of the present invention is to further improve the known escape stocking-based evacuation systems from ship to raft.

BRIEF DESCRIPTION OF THE DRAWINGS

The object and others are achieved by means of a system as disclosed by the appended claims. The implementation and the embodiment of the system according to the invention will now be described with reference to the figures, in which:

DETAILED DESCRIPTION

Figure 1:
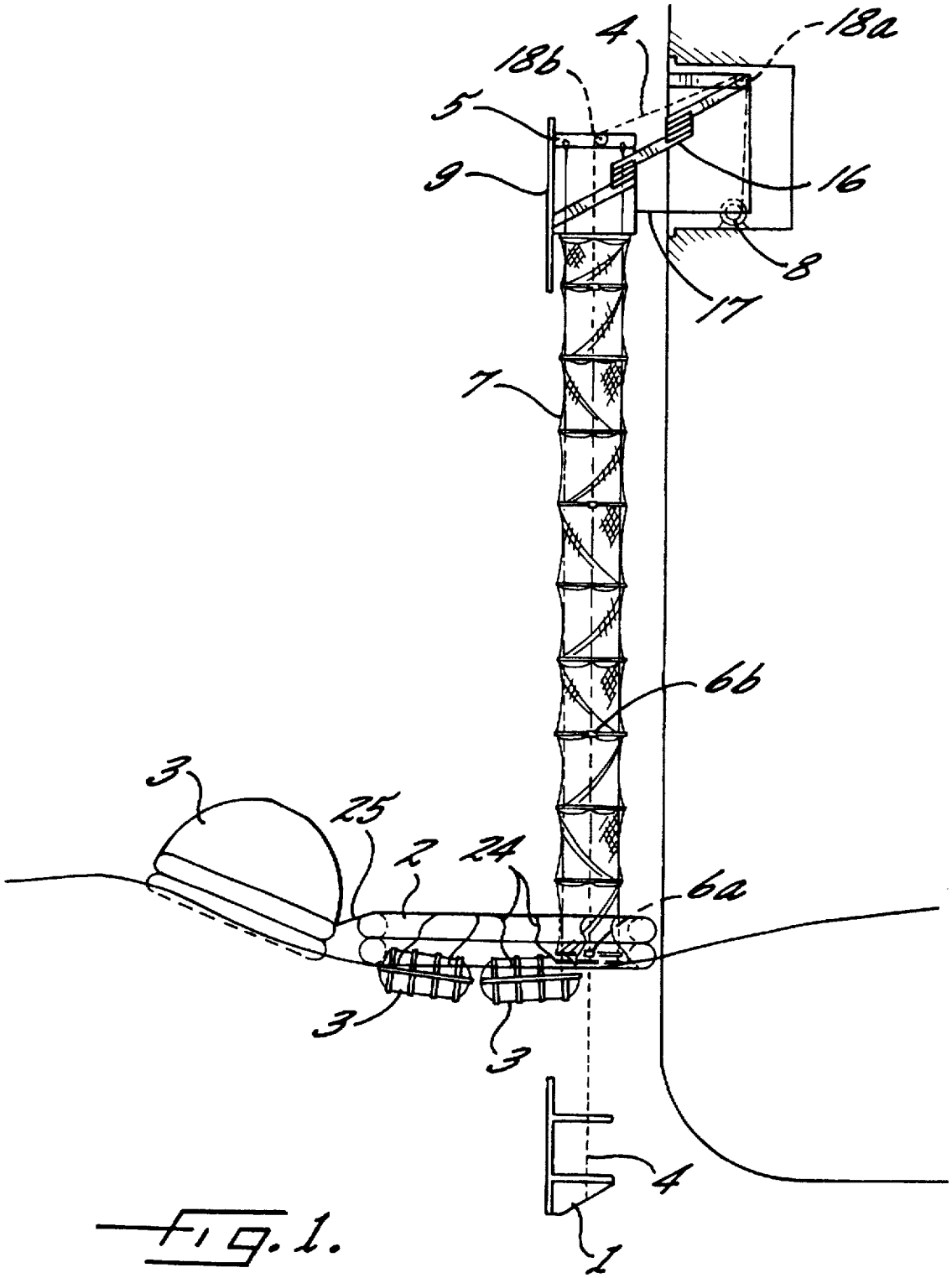
FIG. 1 is an embodiment in a position where it is ready for evacuation.

The system comprises principally a group of packed life rafts 3, a reception raft 2, a bottom frame 1 which can also act as a stabilizing weight, at least one foldable escape stocking 7, a support frame 5 with an arrangement for transfer from a parked position to an operative position outside the ship's side, one or more winch wires 4 and one or more winches 8.

Figure 4:
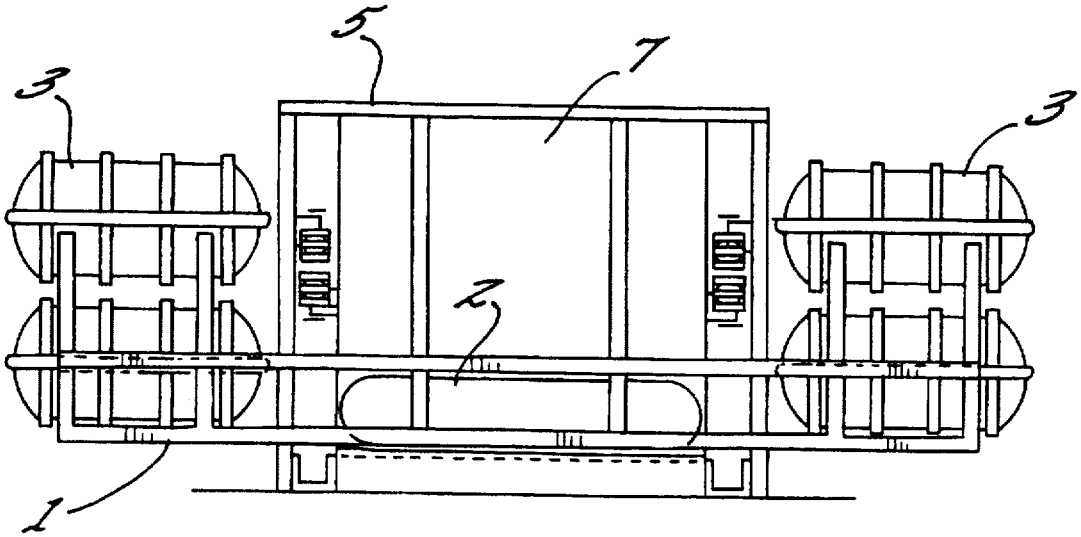
FIG. 4 is an embodiment of the invention in packed condition on deck, viewed from the side.
Figure 5:
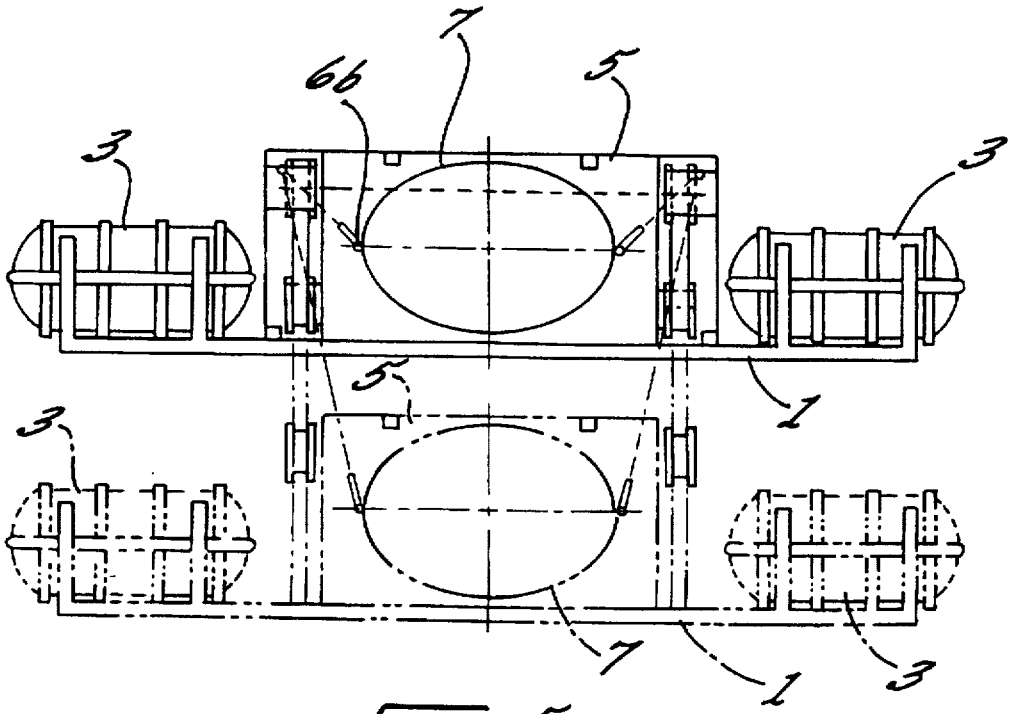
FIG. 5 is the same embodiment viewed from above, and with an outline shown in broken lines illustrating how the support frame 5 with important parts including the bottom frame 1 and rafts 3 is pushed out from the ship's side before the bottom frame and rafts are lowered.
Figure 8:
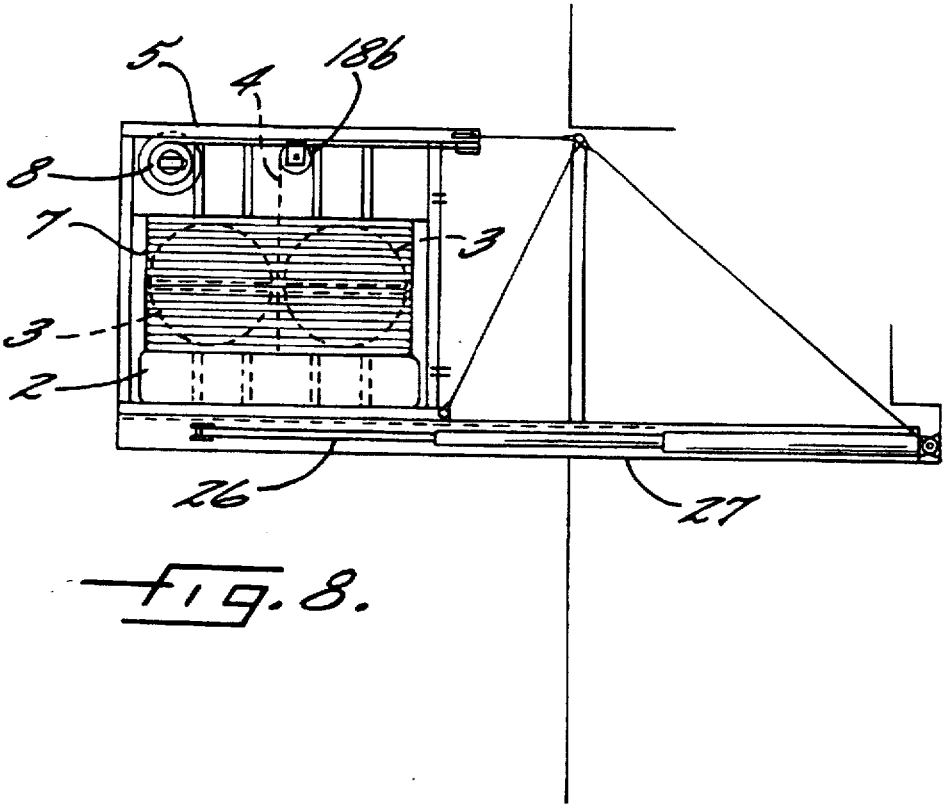
FIG. 8 is an alternative embodiment where the support frame 5 is pushed out by a substantially horizontal telescopic mechanism 27 operated by a hydraulic telescope cylinder 26 connected with a hydraulic accumulator.

The winch 8 can be mounted on the support frame 5 as in FIG. 8 or permanently mounted on the ship's deck as in FIGS. 1–7. In the latter case the winch wires 4 pass over pulleys 18*a*, 18*b* mounted on the support frame 5. In each case the winch wires extend further from the support frame through wire guides 6*b* on the rings in the foldable rescue stocking 7, through wire guides 6*a* in the bottom of the reception raft and on to termination points in the bottom frame 1. The bottom frame 1 can be lowered into the water and have a more or less stabilizing effect on the stocking and reception raft depending on the weight, design and depth in the water. In order to prevent the bottom frame 1 from moving sideways in the water due to current resistance during the heaving movements of the boat, the bottom frame can either be a heavily perforated, streamlined, open grid construction or designed as a compact weight. The tension in the wires 4 can also be stabilized by giving the winch 8 a known per se constant tension function. For example, the winch 8 which supports the bottom frame 1 can be of a type which absorbs a minimum tension in the support wires if the support frame and bottom frame are moved relative to each other during operation. The packed life rafts 3 can rest on projecting arms on the bottom frame 1 as illustrated in FIG. 4 and FIG. 5, or they can be suspended from hooks or straps under the bottom frame as in FIG. 7.

In both cases the life rafts 3 are deployed in such a way that they are released from the bottom frame 1 by their own buoyancy when the bottom frame is lowered into the water by means of the winch 8, while simultaneously the stocking 7 is unfolded and the reception raft 2 inflated. The life rafts 3, however, will still be detachably connected with the reception raft 2 by means of a mooring rope 24 and possibly also release cords 25. The reception raft 2 is kept in position laterally by the wires 4, but is permitted to follow the vertical wave movements independently of the vertical movements of the bottom frame and support frame, thanks to the vertical freedom of movement of the wire guides 6*a*, 6*b*. The invention does not comprise any special new features in the actual rescue stocking, which can in principle be of any known type. In the preferred illustrated embodiment, which is protected by, amongst others, NO patent 149760, the length of the escape stocking 7 is automatically adapted to suit the distance between the support frame 5 and the reception raft 2, while at the same time the stocking is constantly extended approximately in a vertical position and very little affected by wind, by means of the wires 4 and the wire guides 6*b*. In this example, the escape stocking 7 is partially unfolded or folded from below according to requirements, in the bottom of the reception raft 2.

In relation to previously known evacuation systems for ships, the invention according to the principle claim offers the following advantages amongst others:

Even during the actual lowering of the escape stocking 7 not only is the reception raft 2 included, but also a set of life rafts 3, thus immediately establishing a complete escape route away from the ship.

The evacuees are not exposed to risk in the critical lowering phase for raft, lifeboat or equipment.

The evacuation means is continuously available once it is lowered into an operative position.

The device is normally stowed in a position protected from the effects of wind and weather with the result that the system requires little maintenance and will be highly accessible.

The winch wires 4 in the wire guides 6*a*, 6*b* and the weight of the bottom frame 1 stabilize the stocking 7 and the reception raft 2 in an operative position against wind and sea forces.

The rescue system is supplied as a complete and compact unit, which in itself is sufficient to initiate evacuation independently of any separate raft systems or the like.

The entire system can be operated with a very few simple movements, and a minimum of demands are made on the operator's competence.

Embodiments for which protection is sought by dependent claims comport in various combinations the following possible extra advantages:

The system can be built into the ship's side behind a hatch 9 which is opened at the same time as the support frame 5 is pushed out into an operative position. This means that evacuees avoid the necessity of going out on to an open deck before evacuation can start. It also means that the ship's external design can be more freely formulated.

Figure 2:
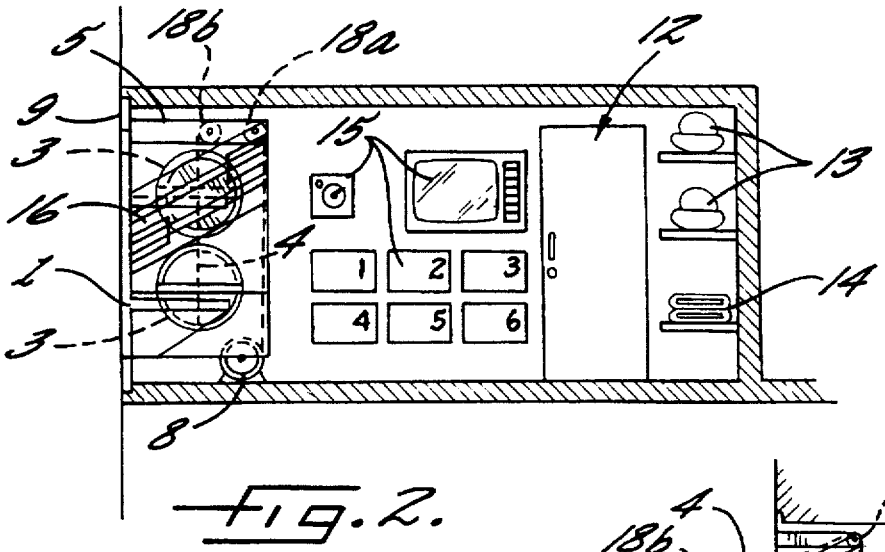
FIG. 2 is a preferred arrangement for installation of the invention aboard a passenger ship in a normal sailing situation without increased readiness.
Figure 3:
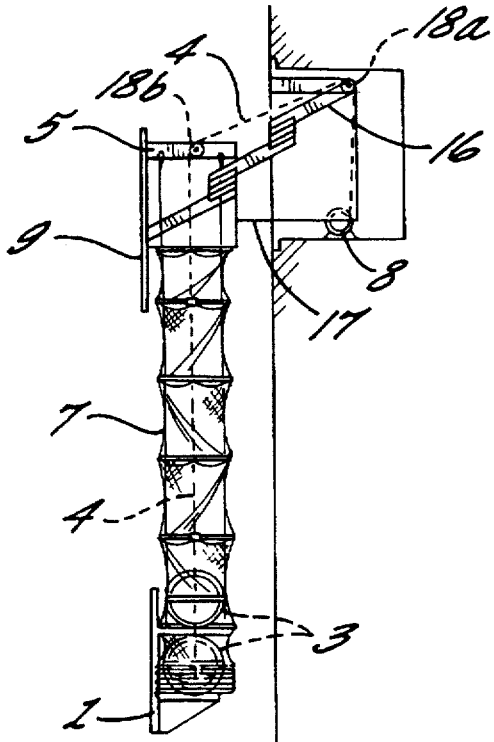
FIG. 3 is an embodiment according to the invention during deployment.

Evacuation can take place directly from the restaurant or restaurant deck. FIG. 2 shows an embodiment in which lifebelts 13 and warm clothing 14 are available in a fire-protected room 12 with preferably direct access from one of the ship's most frequented rooms such as a dance restaurant. Descent in the escape stocking can be carried out directly from this room, preferably according to instructions from audiovisual aids 15.

Figure 6:
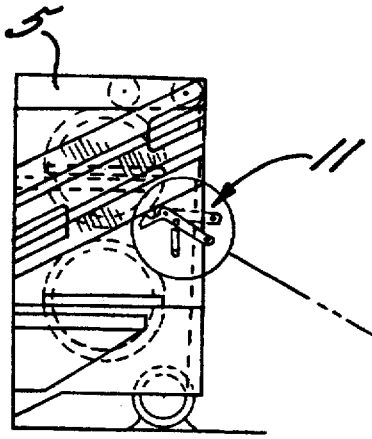
FIG. 6 is an embodiment of a locking mechanism for the support frame which functions in such a manner that the force of gravity alone pushes out the support frame when the locking mechanism is released and FIG. 6A is an enlarged detailed portion of FIG. 6.
Figure 6A:
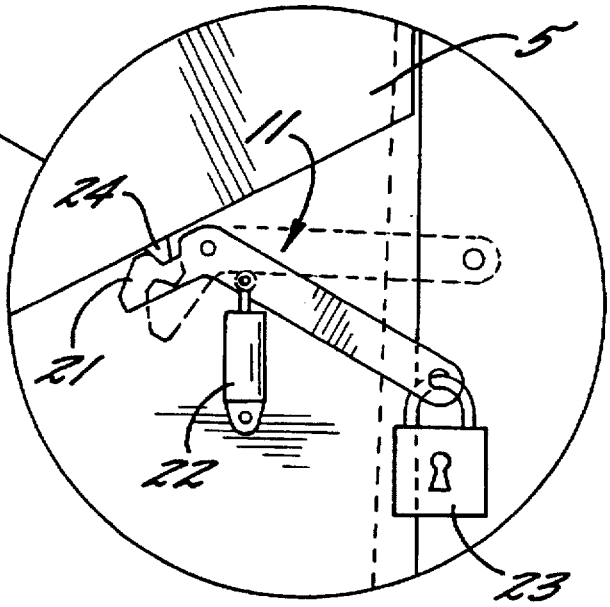
Figure 7:
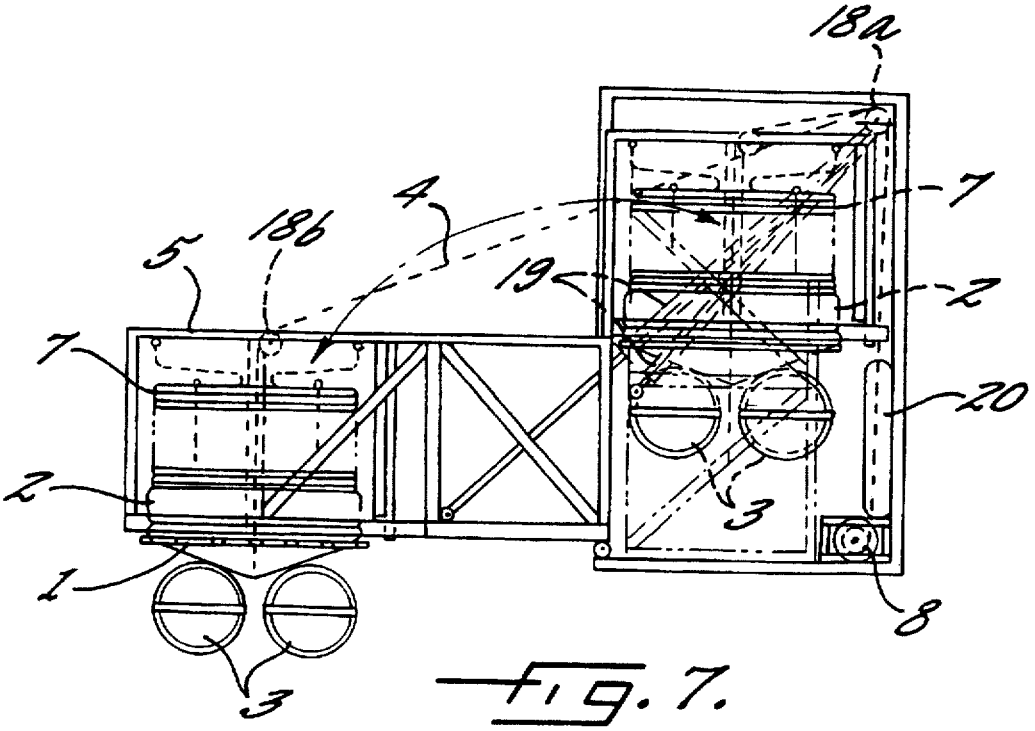
FIG. 7 is an alternative embodiment in which the support frame 5 is hinged and is tilted out hydraulically 19.

The system can be designed in such a manner that the force of gravity alone can move the support frame 5 from a parked to an operative position by means of an extrusion mechanism 16 when a locking mechanism 11 is released, see FIGS. 6 and 6A. The extrusion mechanism 16 can be designed in several ways, e.g. by means of a hinged mounting of the support frame under the lower rear edge, by having the support frame move on rollers in tracks for this purpose, or by means of another mechanism design which in the course of the movement from parked to operative position never passes a position where the device's centre of gravity is located higher than or as high as in a parked position. However, the possibility of gravity-operated extrusion mechanisms 16 is not a limiting factor for the extent of protection, since the mechanism according to the main claim can also include hydraulic cylinders 19, 26 or other powered extrusion mechanisms.

All the vital functions of the system, including extrusion of the support frame 5 and subsequent lowering of the bottom frame 1 with reception raft 2, stocking 7 and rafts 3, can be remotely controlled from the bridge. This can, e.g., also be easily extended to include opening of door locks to the evacuation room 12 and starting of the instruction video 15 together with the obvious activation of alarms etc. Even though facilities of this nature cannot replace the need for human contact and individual help from the crew, it can free the crew to take care of all those who cannot manage on their own with the help of such pre-programmed instructions and aids. This kind of possibility for remote control from the bridge is also an advantage in view of the fact that it is always the captain on the bridge who has the responsibility for the passengers and crew and who gives orders as to when evacuation should begin and which evacuation means should be used. However, the device does not necessarily have to be operated from the bridge. On the contrary it will clearly be advantageous in view of the risk of interruptions in power, hydraulic or communication networks in a crisis situation that the device can be easily operated locally if the situation so demands.

On account of the risk of a "dead ship" (failure of the power supply), it is also desirable that the winch 8 which is used during lowering of the bottom frame with rafts and escape stocking can be operated without an external power supply. This can be solved in several known per se ways, e.g. by providing the winch with an independent diesel-operated power or hydraulic set, by using a hydraulic accumulator 20 or an electrical accumulator, or by providing the winch with a hydraulic or mechanical brake, e.g. a centrifugal brake, which gives a controlled lowering speed with gravity as the motive power. The latter is sufficient for deployment in the case of the embodiment according to FIGS. 1–6, where the force of gravity supplies all the power necessary for deploying the rescue system to the ready-for-use position which is illustrated in FIG. 1.

In those embodiments where deployment is implemented by means of the force of gravity, a simple blocking mechanism is necessary to keep the system packed when it is not in use. An example of such a simple blocking mechanism 11 is illustrated in FIG. 6. Here the locking arm 21 engages with a cut-out 24 on the support frame 5. The locking arm 21 can be actuated manually when the padlock 23 is removed, or it can be actuated by the one-way cylinder 22 which can be remotely controlled from the bridge, and which if necessary can be supplied with sufficient force to break the padlock 23. The key to the padlock 23 can be carried by all the crew members, or it can be placed behind a breakable glass in an alarm activator.

If a winch drum is used with brake but without a permanent motor, the drum shaft can be equipped with splines or similar means suitable for a portable air motor or the like, thus enabling the system to be pulled up again after an exercise. A simple hydraulic pump can also be used on the drum shaft, which acts as a brake when the fluid flow in a locally closed circuit is choked. This local system can obtain its oil from a small tank located at a greater height, while at the same time there can be a connection point for external supply of hydraulic oil under pressure from a portable unit, if the pump is to be used as a motor for pulling the system up again.

I claim:

1. A system for deploying life rafts from a ship in water, wherein the life rafts are inflatable and wherein there is at least one stocking for transferring people from the ship to at least one of the life rafts, comprising groups of packed life rafts which are loosely connected with a common bottom frame, wherein each group comprises a reception raft and several evacuation rafts detachably connected with the reception raft, wherein said bottom frame is suspended from at least one winch wire arranged from a support frame, said support frame being movable between a parked position inside a side of the ship and an operative position outside the ship's side, wherein the bottom frame can be winched in a controlled manner down into the water from the support frame when the support frame is in said operative position, wherein the winch wire passes through a sliding guide in the bottom of the reception raft and also through a sliding guide in said at least one rescue stocking which is permanently connected at an upper end with the support frame and a lower end rests on the reception raft, and the evacuation rafts are partially released from the bottom frame and remain afloat on the water when the bottom frame is lowered below the water, and the reception raft is automatically inflated after being released from the bottom frame while the attached evacuation rafts can be manually released from the reception raft as required, thus maintaining a continuous, safe escape route from the ship to the raft.

2. A system according to claim 1, wherein the said bottom frame can be lowered to a depth in the water approximately free of wave influence and that the bottom frame has a weight and design which make it suitable for stabilizing the winch wire.

3. A system according to claim 1, further comprising a winch which supports the bottom frame and which absorbs a minimum tension in the winch wire if the support frame and bottom frame are moved relative to each other during operation.

4. A system according to claim 1, wherein when it is not in use the entire system is inserted behind a hatch in a side of the ship to thereby be protected against wind and weather, but in full readiness for evacuation.

5. A system according to claim 4, wherein the hatch in the ship's side is opened automatically by the support frame when the support frame is moved from a parked to an operative position.

6. A system according to claim 5, wherein the hatch is an integral part of the support frame and the moving of the support frame and the opening or closing of the hatch is performed telescopically.

7. A system according to claim 1, wherein the support frame is suspended from a mechanism which is of such a nature that the force of gravity alone can move the support frame from a parked to an operative position when a locking mechanism is released.

8. A system according to claim 7, wherein the support frame is suspended from a telescopic mechanism which is tilted so that the force of gravity on an extruded direction of the telescopic mechanism is sufficient to overcome friction when the locking mechanism is released.

9. A system according to claim 4, wherein the system is arranged inside a fireproof room together with life-jackets and other equipment.

10. A system according to claim 1, wherein vital functions of the system can be remotely controlled from the ship.

* * * * *